US012338573B2

(12) United States Patent
Jung et al.

(10) Patent No.: US 12,338,573 B2
(45) Date of Patent: Jun. 24, 2025

(54) METHOD FOR MANUFACTURING ANTIBACTERIAL AND DEODORIZING AGENT, USING ECO-FRIENDLY BIOPOLYMER

(71) Applicant: GCLO, Daegu (KR)

(72) Inventors: Jay Jaehun Jung, Daegu (KR); Ji Young Kim, Daegu (KR)

(73) Assignee: GCLO, Daegu (KR)

( * ) Notice: Subject to any disclaimer, the term of this patent is extended or adjusted under 35 U.S.C. 154(b) by 441 days.

(21) Appl. No.: 17/918,885

(22) PCT Filed: Apr. 28, 2020

(86) PCT No.: PCT/KR2020/005547
§ 371 (c)(1),
(2) Date: Oct. 13, 2022

(87) PCT Pub. No.: WO2021/210714
PCT Pub. Date: Oct. 21, 2021

(65) Prior Publication Data

US 2023/0257930 A1 Aug. 17, 2023

(30) Foreign Application Priority Data

Apr. 16, 2020 (KR) ..... 10-2020-0046311

(51) Int. Cl.
*D06M 15/03* (2006.01)

(52) U.S. Cl.
CPC ..... *D06M 15/03* (2013.01); *D10B 2401/13* (2013.01)

(58) Field of Classification Search
CPC .. D06M 15/03; D06M 13/184; D06M 13/207; D06M 16/00; D06M 11/13; D06M 11/155; D06M 11/46; D06M 11/79; D10B 2401/13
See application file for complete search history.

(56) References Cited

U.S. PATENT DOCUMENTS

2023/0175198 A1* 6/2023 Jung ..... D06M 13/188 252/8.61

FOREIGN PATENT DOCUMENTS

| | | | |
|---|---|---|---|
| JP | 08-268821 | A | 10/1996 |
| JP | 2008-081876 | A | 4/2008 |
| JP | 2019-526716 | A | 9/2019 |
| KR | 10-0144507 | B1 | 7/1998 |
| KR | 10-2002-0072253 | A | 9/2002 |
| KR | 10-2004-0049369 | A | 6/2004 |
| KR | 10-0767336 | B1 | 10/2007 |
| KR | 10-2016-0001060 | A | 1/2016 |
| KR | 10-1591470 | B1 | 2/2016 |

* cited by examiner

*Primary Examiner* — Anthony J Green
(74) *Attorney, Agent, or Firm* — GOLDILOCKS ZONE IP LAW

(57) ABSTRACT

The present invention relates to a method for manufacturing a biopolymer-based fabric processing agent that is eco-friendly, renewable, and biodegradable, and specifically, to a method for manufacturing a fabric processing agent, the method comprising the steps of: dissolving, at room temperature, a solution containing an organic acid and a residual solvent; a step for stirring chitosan and distilled water in the solution; and a step for preparing an aqueous solution in which a mineral substance is dissolved.

19 Claims, 1 Drawing Sheet

[FIG. 1]
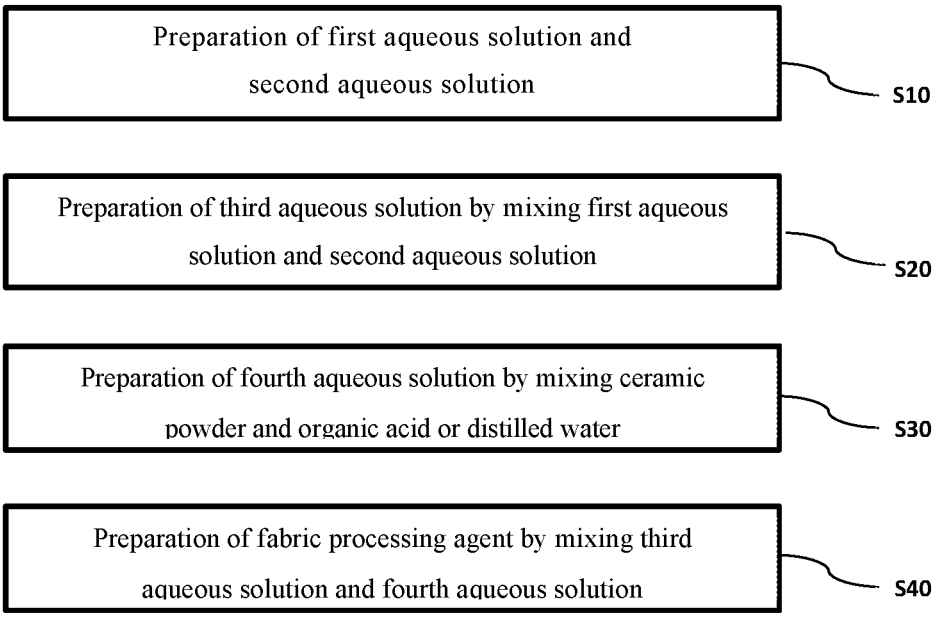
[FIG. 2]
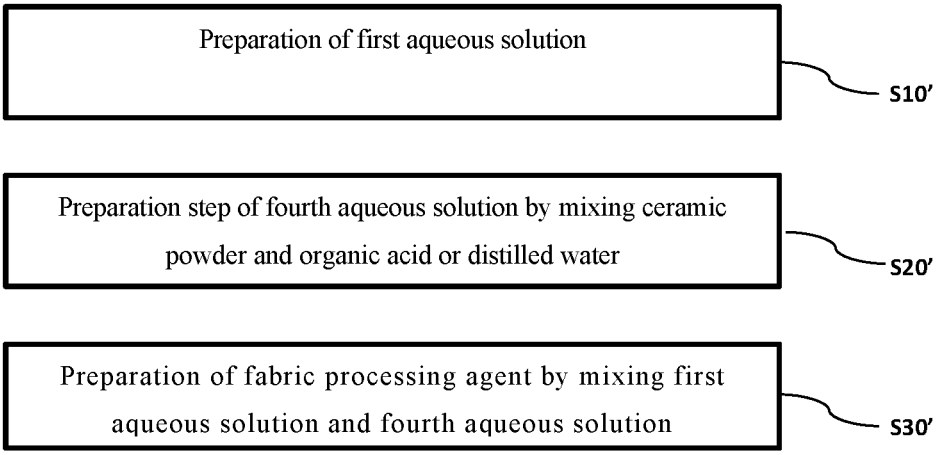

METHOD FOR MANUFACTURING ANTIBACTERIAL AND DEODORIZING AGENT, USING ECO-FRIENDLY BIOPOLYMER

CROSS-REFERENCE TO RELATED APPLICATIONS

This application claims the benefit under 35 U.S.C. section 371, of PCT International Application No. PCT/KR2020/005547, filed on Apr. 28, 2020, which claims priority to Korean Patent Application No. 10-2020-0046311, filed on Apr. 16, 2020, in the Korean Intellectual Property Office, both of which are hereby incorporated by reference in their entireties.

TECHNICAL FIELD

The present invention relates to a method for manufacturing a biopolymer-based fabric processing agent that is eco-friendly, renewable, and biodegradable, and more particularly, to a method for manufacturing a fabric processing agent that can maintain comfort by emitting far-infrared rays while having antibacterial and deodorizing functions when applied to clothes, by mixing a mineral substance and a ceramic dispersion solution in an aqueous solution of chitosan dissolved in an organic acid.

BACKGROUND ART

Conventionally, a zeolite-based antibacterial agent containing heavy metal ions such as zinc, silver, and copper ions is known as an antibacterial agent whose antibacterial effect against bacteria and fungi lasts for a long period of time. In particular, as for the types of heavy metal ions, silver ions are widely used in recent years due to their superiority, particularly in the area of safety. As for the bactericidal power efficacy and deodorizing power efficacy immediately after the treatment, silver ions do not provide sufficient bactericidal performance compared to oxidizing agents such as chlorine-based bactericides, and to solve this problem, in place of a zeolite-based antibacterial agent, an antibacterial agent is proposed that contains a silver-chloro complex salt and oxidizing agent. However, it is apparent that, so long as fast-acting silver ions can be produced from a silver zeolite, then odor-generating bacteria can be killed and deodorization can be achieved as a result. However, despite the special deodorizing and antibacterial abilities of silver ions, the regulation of silver ions-containing products is restricted worldwide due to the harmfulness of heavy metals to the human body, and in the future, it will be difficult to change the perception of silver ions and their harmfulness to the human body.

On the other hand, polyhexamethyleneguanidine (polyhexamethyleneguanidine phosphate, hereinafter PHMG), ethoxyethylguanine chloride (oligo-[2-(2-ethoxy)-ethoxy-eth-yl)-guanidinium-chlorid, hereafter PGH) are guanidine-based disinfectants and have been used variously as an anti-infective and antibacterial agent. These disinfectants were used as humidifier disinfectants in Korea. However, when dozens of people died in 2011, it was designated as hazardous chemicals and their use are gradually being banned in the United States and Europe.

Substances such as PGH and PHMG have excellent bactericidal power efficacy, but several problems have been reported. Since they are not biodegradable, there is concern about environmental pollution, and aquatic toxicity is serious, showing very high toxicity even at 10 μg/L (0.000001%, 0.054 μM, 0.01 ppm). In addition, the substances are prohibited to use as a spray due to inhalation toxicity, and it can be very dangerous if the substances are manufactured and used as a product by arbitrarily and indiscriminately applied without regulation. Since the PGH and PHMG ingredients show a sterilization efficacy by destroying phospholipid bilayers, there is a possibility of destroying cellular phospholipids in humans, and there is a risk of destroying the skin barrier. Therefore, if these ingredients are used frequently on the skin, such as wet wipes, they are more likely to cause dermatitis. Therefore, it is necessary to continuously study the harmfulness related to antibacterial and deodorant.

Meanwhile, in general, the use of a synthetic binder having adhesive properties in order to provide semi-permanent durability even after washing is essential for a fabric processing agent used for fabrics. As synthetic binders used, there are acrylic binders, urethane binders, and the like, but the harmfulness of these synthetic binders in the manufacturing process has not been properly verified.

Currently, the textile industry is replacing fabric materials with recycled polyethylene terephthalate (recycle PET) and nylon for sustainable and eco-friendly production and consumption. It is important to replace fabric materials, but it is also necessary to replace fabric processing materials with materials that can be produced and consumed in a sustainable and eco-friendly manner.

DISCLOSURE

Technical Problem

An object of the present invention is to provide a fabric processing agent that can maintain comfort by emitting far-infrared rays while having antibacterial and deodorizing functions when applied to clothes by mixing a mineral substance and a ceramic dispersion solution in an aqueous solution of chitosan dissolved in an organic acid.

Technical Solution

In order to achieve the object, in an embodiment of the present invention, a fabric processing agent is manufactured by including the steps of preparing a first aqueous solution containing an organic acid and chitosan and a second aqueous solution containing a metal salt or an acidic solution; preparing a third aqueous solution in which a mixing ratio of the first aqueous solution to the second aqueous solution is a ratio of 2:1 to 10:1 by weight; preparing a fourth aqueous solution in which a mixing ratio of ceramic powder to the organic acid is a ratio of 1:20 to 1:1000 by weight; and preparing a fabric processing agent in which a mixing ratio of the third aqueous solution to the fourth aqueous solution is a ratio of 1:5 to 5:1 by weight.

As another embodiment of the present invention, a fabric processing agent is manufactured by including the steps of preparing a first aqueous solution containing an organic acid and chitosan; preparing a fourth aqueous solution in which a mixing ratio of ceramic powder to the organic acid is a ratio of 1:20 to 1:1000 by weight; and preparing a fabric processing agent in which a mixing ratio of the first aqueous solution to the fourth aqueous solution is a ratio of 1:5 to 5:1 by weight.

As another embodiment of the present invention, a fabric processing agent is manufactured in characterized in that the organic acid is at least one selected from the group consisting of lactic acid, citric acid, mandelic acid, and acetic acid.

As another embodiment of the present invention, a fabric processing agent is manufactured in characterized in that in the first aqueous solution, a mixing ratio of the organic acid to the chitosan is a ratio of 1:5 to 5:1 by weight.

As another embodiment of the present invention, a fabric processing agent is manufactured in characterized in that a viscosity of the chitosan is 500 to 1200 cps.

As another embodiment of the present invention, a fabric processing agent is manufactured in characterized in that a deacetylation degree of the chitosan is 80 to 99.99%.

As another embodiment of the present invention, a fabric processing agent is manufactured in characterized in that a molecular weight of the chitosan is 10,000 to 1,000,000 g/mol.

As another embodiment of the present invention, a fabric processing agent is manufactured in characterized in that the ceramic powder is at least one selected from the group consisting of zeolite powder, illite powder, montmorillonite powder, mica powder, diatomaceous earth powder, zirconia powder, and carbon powder.

As another embodiment of the present invention, a fabric processing agent is manufactured in characterized in that in the step of preparing a first aqueous solution, an aqueous solution containing 0.01 to 5% by weight of the organic acid and an aqueous solution containing 0.01 to 5% by weight of the chitosan are stirred at room temperature at a speed of 100 to 1,000 rpm.

As another embodiment of the present invention, a fabric processing agent is manufactured in characterized in that in the second aqueous solution, a mixing ratio of the metal salt or the acidic solution to distilled water is a ratio of 1:10 to 1:1000 by weight.

As another embodiment of the present invention, a fabric processing agent is manufactured in characterized in that the metal salt is at least one selected from sodium chloride, calcium chloride, potassium chloride, sodium gluconate, and magnesium chloride.

As another embodiment of the present invention, a fabric processing agent is manufactured in characterized in that the acidic solution is at least one selected from the group consisting of alginic acid, malic acid, acetic acid, citric acid, calcium acetate monohydrate, butyl lactate, ethyl lactate, and glycerin.

As another embodiment of the present invention, a fabric treated with the above fabric processing agent has a far-infrared emissivity of 87 to 90% at a wavelength of 5 to 20 μm, and a far-infrared radiation energy of $3.35\times10^2$ to $3.63\times10^2$ $W/m^2\cdot\mu m$ at 30 to 45° C.

Advantageous Effect

The present invention can provide a fabric processing agent that is much more eco-friendly and safer than conventional antibacterial agents or chemicals by manufacturing a fabric processing agent using substances such as chitosan, an organic acid, and ceramic powder.

In addition, the fabric processing agent has an effect of maintaining comfort by emitting far-infrared rays as well as antibacterial and deodorizing functions when applied to clothes.

DESCRIPTION OF DRAWINGS

FIG. 1 is a flowchart illustrating a method for manufacturing a fabric processing agent according to an embodiment of the present invention.

FIG. 2 is a flowchart illustrating a method for manufacturing a fabric processing agent according to another embodiment of the present invention.

- S10: preparing step of a first aqueous solution and a second aqueous solution
- S20: preparing step of a third aqueous solution
- S30: preparing step of a fourth aqueous solution
- S40: preparing step of a fabric processing agent in which the third aqueous solution and the fourth aqueous solution are mixed
- S10': preparing step of a first aqueous solution
- S20': preparing step of a fourth aqueous solution
- S30': preparing step of a fabric processing agent in which the first aqueous solution and the fourth aqueous solution are mixed

BEST MODE FOR INVENTION

The present invention maximizes antibacterial and deodorizing functions by mixing chitosan in an organic acid aqueous solution to prepare a solution, and then mixing ceramic powder with the solution to prepare an eco-friendly fabric processing agent.

A first aqueous solution of the present invention may include an organic acid and chitosan, and the mixing ratio of organic acid to chitosan may be a ratio of 1:5 to 5:1 by weight.

The first aqueous solution of the present invention may be produced by stirring the organic acid aqueous solution and the chitosan aqueous solution at room temperature at a speed of 100 to 1000 rpm. The temperature range of room temperature may be 0 to 80° C., preferably 15 to 50° C. When the organic acid aqueous solution and the chitosan aqueous solution are stirred at room temperature at a speed of 100 to 1000 rpm, the chitosan of high viscosity and high molecular weight is completely dispersed and dissolved in the organic acid aqueous solution.

The organic acid aqueous solution may contain 0.01 to 5% by weight of an organic acid, preferably 0.01 to 1% by weight of an organic acid. When the aqueous solution contains 0.01 to 5% by weight of the organic acid, as a functional fabric processing agent, it is processed into fabrics, making the change of touch appropriate, and can be commercialized as a product.

The organic acid may be at least one selected from the group consisting of lactic acid, citric acid, mandelic acid, and acetic acid, and the organic acid may be preferably citric acid. The organic acid is used to dissolve chitosan in water, and among them, citric acid is combined with chitosan to maximize antibacterial properties.

On the other hand, the chitosan aqueous solution may contain 0.01 to 5% by weight of chitosan, preferably 0.01 to 1% by weight of chitosan. When the chitosan aqueous solution contains 0.01 to 5% by weight of chitosan, the antibacterial, deodorizing, and far-infrared emission effects can be maximized.

The deacetylation degree of the chitosan may be 50 to 99.99%, preferably 80 to 99.99%. In general, as the deacetylation degree increases, the antibacterial, deodorizing, and far-infrared emission effects increase. Also, even in the present invention, the antibacterial property is increased when the deacetylation degree of the chitosan is 80 to 99.99%, and when the deacetylation degree of the chitosan is lower than 80%, there may be a problem in that the antibacterial and deodorizing properties of a product are lowered.

The viscosity of the chitosan may be 500 to 1200 cps, preferably 700 to 1200 cps. When the viscosity of the chitosan is lower than 500 cps, there may be a problem in durability during fabric processing, and when the viscosity of the chitosan is higher than 1200 cps, the compatibility that can be applied to fabrics is lowered.

The molecular weight of the chitosan may be 1,000 to 2,000,000 g/mol. When the molecular weight of the chitosan is 1,000 g/mol or less, the properties of chitosan as a polymer inevitably decrease, and when the molecular weight is 2,000,000 g/mol or more, the bonding between the chitosan and the organic acid is not formed well.

The molecular weight of the chitosan may be preferably 10,000 to 1,000,000 g/mol. When the molecular weight of the chitosan is lower than 10,000, there may be a problem in the role as a natural binder during processing of fabrics, and when the molecular weight of the chitosan is higher than 1,000,000, there may be a problem in the touch performance of fabrics.

The second aqueous solution of the present invention may include a metal salt or an acidic solution, and the mixing ratio of the metal salt or the acidic solution to distilled water may be a ratio of 1:10 to 1:1000 by weight. By mixing the metal salt or the acidic solution and the distilled water in the same ratio as described above, the metal salt or the acidic solution can be sufficiently dissolved in the distilled water.

The metal salt or acidic solution may be added to the first aqueous solution to further maximize the antibacterial and deodorant functions, and may also serve as a preservative of the first aqueous solution.

The metal salt may be at least one selected from sodium chloride, calcium chloride, potassium chloride, sodium gluconate, and magnesium chloride.

The acidic solution may be at least one selected from the group consisting of alginic acid, malic acid, acetic acid, citric acid, calcium acetate monohydrate, butyl lactate, ethyl lactate, and glycerin.

The third aqueous solution of the present invention may be a solution in which the mixing ratio of the first aqueous solution to the second aqueous solution is a ratio of 2:1 to 10:1 by weight. By mixing the first aqueous solution and the second aqueous solution in the same ratio as above, the dispersion and solubility of the chitosan aqueous solution are increased, and the antibacterial, deodorizing and far-infrared emission functions can be further maximized by adding a mineral substance.

The fourth aqueous solution of the present invention may be a solution in which the mixing ratio of ceramic powder to organic acid or distilled water is a ratio of 1:20 to 1:1000 by weight. By mixing the ceramic powder with the organic acid or distilled water in the same mixing ratio as described above, the ceramic powder can be dispersed in a solvent so that the solution can be mixed with the aqueous chitosan solution.

The ceramic powder may be at least one selected from the group consisting of zeolite powder, illite powder, montmorillonite powder, mica powder, diatomaceous earth powder, zirconia powder, and carbon powder.

The mica and diatomaceous earth powder may be at least one selected from the group consisting of diatomaceous earth, sericite, biotite, muscovite, tourmaline, germanium, magnetite, charcoal, and graphite.

The fabric processing agent of the present invention may be prepared by mixing the fourth aqueous solution with the first aqueous solution in a ratio of 1:5 to 5:1, or by mixing the fourth aqueous solution with the third aqueous solution in a ratio of 1:5 to 5:1. By mixing in such a mixing ratio, the chitosan aqueous solution and the ceramic dispersion solution are properly mixed, so that the ceramic powder does not sink even after a sufficient time has elapsed and can be stably maintained.

Hereinafter, a method for manufacturing a fabric processing agent according to an embodiment of the present invention will be described in detail.

FIG. 1 is a flowchart illustrating a method for manufacturing a fabric processing agent according to an embodiment of the present invention.

Referring to FIG. 1, a method for manufacturing a fabric processing agent according to an embodiment of the present invention includes the steps of preparing a first aqueous solution and a second aqueous solution (S10), preparing a third aqueous solution by mixing the first aqueous solution and the second aqueous solution (S20), preparing a fourth aqueous solution by mixing ceramic powder and an organic acid or distilled water (S30), and preparing a fabric processing agent by mixing the third aqueous solution and the fourth aqueous solution (S40).

In the step (S10), after sufficiently dissolving 0.01 to 5% by weight of an organic acid such as lactic acid, citric acid, mandelic acid, and acetic acid in distilled water at room temperature of 15 to 50° C., 0.01 to 5% by weight of high molecular weight chitosan with a deacetylation degree of 80 to 99.99% and a viscosity of 500 to 1200 CPS are sufficiently dissolved in distilled water while being stirred at 200 to 300 rpm at room temperature for 24 hours, thereby preparing the first aqueous solution. Also, the second aqueous solution is prepared by dissolving distilled water and a sea salt containing 98% or more of sodium chloride in a ratio of 2:1 to 10:1 by weight at room temperature of 15 to 50° C. for about 30 minutes. Here, the sea salt may be replaced with at least one substance selected from the group consisting of magnesium chloride, alginic acid, malic acid, acetic acid, citric acid, calcium acetate monohydrate, butyl lactate, ethyl lactate, and glycerin.

In the step (S20), the third aqueous solution in which a mixing ratio of the first aqueous solution to the second aqueous solution is a ratio of 2:1 to 10:1 by weight is prepared.

In the step (S30), the fourth aqueous solution is prepared by mixing the zeolite powder with the organic acid in a ratio of 1:20 to 1:1000 by weight and dissolving the mixture at room temperature of 15 to 50° C.

In the step (S40), the mixing ratio of the fourth aqueous solution to the third aqueous solution may be a ratio of 1:5 to 5:1 by weight to prepare a fabric processing agent. The zeolite powder may be replaced with at least one substance selected from the group consisting of illite powder, montmorillonite powder, mica powder, diatomaceous earth powder, zirconia powder, and carbon powder. Here, after mixing the third aqueous solution and the fourth aqueous solution, the mixture is stirred at room temperature of 15 to 50° C. to finally prepare a fabric processing agent.

Hereinafter, a method for manufacturing a fabric processing agent according to another embodiment of the present invention will be described in detail.

FIG. 2 is a flowchart showing a method for manufacturing a fabric processing agent according to another embodiment of the present invention.

Referring to FIG. 2, a method for manufacturing a fabric processing agent according to another embodiment of the present invention includes the steps of preparing a first aqueous solution (S10'), preparing a fourth aqueous solution by mixing the ceramic powder and the organic acid or distilled water (S20'), and preparing a fabric processing agent by mixing the first aqueous solution and the fourth aqueous solution (S30').

In the step (S10'), after sufficiently dissolving 0.01 to 5% by weight of an organic acid such as lactic acid, citric acid, mandelic acid, and acetic acid in distilled water at room temperature of 15 to 50° C., 0.01 to 5% by weight of high molecular weight chitosan with a deacetylation degree of 80 to 99.99% and a viscosity of 500 to 1200 CPS are sufficiently dissolved in distilled water while being stirred at room temperature for 24 hours at 200 to 300 rpm, thereby preparing the first aqueous solution.

In the step (S20'), the fourth aqueous solution is prepared by mixing zeolite powder with the organic acid in a ratio of 1:20 to 1:1000 by weight and dissolving the mixture at room temperature of 15 to 50° C.

In the step (S30'), the mixing ratio of the first aqueous solution to the fourth aqueous solution may be a ratio of 1:5 to 5:1 by weight to prepare a fabric processing agent. The zeolite powder may be replaced with at least one substance selected from the group consisting of illite powder, montmorillonite powder, mica powder, diatomaceous earth powder, zirconia powder, and carbon powder. Here, after mixing the first aqueous solution and the fourth aqueous solution, the mixture is stirred at room temperature of 15 to 50° C., thereby finally preparing a fabric processing agent.

The fabric treated with the above fabric processing agent has a far-infrared emissivity of 87 to 90% at a wavelength of 5 to 20 μm, and a far-infrared radiation energy of $3.35\times10^2$ to $3.63\times10^2$ $W/m^2\cdot\mu m$ at 30 to 45° C.

The fabric processing agent of the present invention is prepared by a relatively simple method of mixing the fourth aqueous solution with the first aqueous solution in a ratio of 1:5 to 5:1, or mixing the fourth aqueous solution with the third aqueous solution in a ratio of 1:5 to 5:1. After the first aqueous solution or the third aqueous solution is completely reacted, the fourth aqueous solution is finally added, so that chitosan is completely dispersed and dissolved in the organic acid aqueous solution, and the ceramic powder does not sink even after a sufficient time has elapsed and can maintain a stable state.

Therefore, in applying the fabric processing agent to a fabric, when the fabric processing agent is manufactured by the manufacturing method of the present invention, the chitosan and the ceramic powder are evenly dispersed throughout the fabric, thereby maximizing the antibacterial, deodorizing and far-infrared emission effects.

When a user wears clothes made of fabrics treated with the fabric processing agent having the above-described far-infrared emissivity and radiation energy range, the amount of far-infrared radiation may be increased due to direct contact and friction with the human body. As a result, the far-infrared radiation energy absorbed by the skin expands micro-vessels to promote blood circulation, and the far-infrared wavelength that penetrates deep into the body raises the body temperature evenly throughout our body, so that the effect of exercising just by wearing clothes made of fabrics treated with the fabric processing agent can be achieved.

On the other hand, even if the fabric to which the fabric processing agent is applied is washed 50 times or more, it has an excellent characteristic that antibacterial properties are not inhibited, which is due to the fact that the antibacterial function is maintained semi-permanently by optimizing the uniform mixing and dispersing by the manufacturing method of finally adding the fourth aqueous solution after completely reacting the first aqueous solution or the third aqueous solution.

Modes for Embodiments

Hereinafter, specific examples are provided to help the understanding of the present invention. However, the following examples are only provided for easier understanding of the present invention, and the content of the present invention is not limited by the examples.

Example 1: Preparation of a Fabric Processing Agent and its Application to Fabric 1

1. 1 g of chitosan and 3 g of citric acid were stirred in 46 g of distilled water at room temperature (25° C.) at 300 rpm for 24 hours to prepare 50 g of an aqueous solution in which chitosan was dissolved.
2. An aqueous solution of sea salt was prepared by dissolving 0.833 g of sea salt containing 98% or more of sodium chloride in 5 ml of distilled water at 300 rpm for 30 minutes at room temperature (25° C.).
3. 1 g of sericite powder was mixed with 50 ml of distilled water and stirred at room temperature (25° C.) for 1 hour to prepare a dispersion.
4. A processing agent was finally prepared by mixing 55 g of the mixture of the solution prepared in step 1 and the solution prepared in step 2 and 50 ml of the aqueous solution prepared in step 3, and the fabric was processed by mixing the prepared processing agent with water in a ratio of 1:10 during tenter treatment.
5. The finally prepared processing agent was subjected to a tentering process at a temperature condition of 120 to 180° C. with a pickup rate of 50 to 80% of the fabric. The density and dimensions of the fabric were adjusted during the tentering process by adjusting the density of the fabric prepared in a weaving stage to a certain level required as a product.
6. After the tentering process, the fabric was cooled using a cooling cylinder and then wound up to finish the processing process.

Example 2: Preparation of a Fabric Processing Agent and its Application to Fabric 2

1. 1 g of chitosan and 3 g of citric acid were stirred in 46 g of distilled water at room temperature (25° C.) at 300 rpm for 24 hours to prepare 50 g of an aqueous solution in which chitosan was dissolved.
2. 1 g of sericite powder was mixed with 50 ml of distilled water and stirred at room temperature (25° C.) for 1 hour to prepare a dispersion.
3. A processing agent was finally prepared by mixing 50 g of the solution prepared in step 1 and 50 ml of the solution prepared in step 2, and the fabric was processed by mixing the prepared processing agent with water in a ratio of 1:10 during tenter treatment.
4. The finally prepared processing agent was subjected to a tentering process at a temperature condition of 120 to 180° C. with a pickup rate of 50 to 80% of the fabric. The density and dimensions of the fabric were adjusted during the tentering process by adjusting the density of the fabric prepared in a weaving stage to a certain level required as a product.

5. After the tentering process, the fabric was cooled using a cooling cylinder and then wound up to finish the processing process.

Comparative Example 1: Fabric Processing without an Application of a Fabric Processing Agent In Example 1 or Example 2, the processing process was finished by cooling the fabric that was subject to the tendering process without processing the final processing agent using a cooling cylinder and then winding the cooled fabric.

Comparative Example 2: Fabric Processing with a Fabric Processing Agent Containing No Ceramic Powder 1. 1 g of chitosan and 3 g of citric acid were stirred in 46 g of distilled water at room temperature (25° C.) at 300 rpm for 24 hours to prepare 50 g of an aqueous solution in which chitosan was dissolved.

2. An aqueous solution of sea salt was prepared by dissolving 0.833 g of sea salt containing 98% or more of sodium chloride in 5 ml of distilled water at 300 rpm for 30 minutes at room temperature (25° C.).

3. A processing agent was finally prepared by mixing 55 g of the mixture of the solution prepared in step 1 and the solution prepared in step 2, and the fabric was processed by mixing the prepared processing agent with water in a ratio of 1:10 during tenter treatment.

4. The finally prepared processing agent was subjected to a tentering process at a temperature condition of 120 to 180° C. with a pickup rate of 50 to 80% of the fabric. The density and dimensions of the fabric were adjusted during the tentering process by adjusting the density of the fabric prepared in a weaving stage to a certain level required as a product.

5. After the tentering process, the fabric was cooled using a cooling cylinder and then wound up to finish the processing process.

Experimental Example 1: Antibacterial Performance Test

Antibacterial Performance Test of Examples 1 and 2

The antibacterial performance test of the fabric treated with the fabric processing agent prepared in Example 1 was performed. Swiss Universal Standard Technical Service Co., Ltd. (abbreviated as SGS) was requested to test the antibacterial performance, and the results were shown in Table 1. The test strains were *Staphylococcus aureus* ATCC 6538 and *Klebsiella pneumoniae* ATCC 4352, and were tested according to the antimicrobial finishing method for textile materials (AATCC 100-2012). 1 mL of the strain was inoculated into a circular fabric sample with a diameter of 4.8 cm.

As a result of recovering live cells from the fabric sample 24 hours after inoculation, the decrease rates of both *Staphylococcus aureus* and Pneumonia were a 99.9%.

TABLE 1

| Test strain | bacteria con-centration (cfu/mL) | | The number of viable cells recovered over time After 0 hour (cfu/sample) | After 24 hours (cfu/sample) | De-crease rate (%) |
|---|---|---|---|---|---|
| *Staphylococcus aureus* ATCC 6538 | $1.6 \times 10^5$ | sample | $1.0 \times 10^2$ | $1.0 \times 10^2$ | >99.9 |
| | | control sample | $1.5 \times 10^5$ | $5.2 \times 10^7$ | |
| *Klebsiella Pneumoniae* ATCC 4352 | $1.5 \times 10^5$ | sample | $1.0 \times 10^2$ | $1.0 \times 10^2$ | >99.9 |
| | | control sample | $1.4 \times 10^5$ | $2.4 \times 10^7$ | |

On the other hand, the antibacterial performance test of the fabric treated with the fabric processing agent prepared in Example 2 was conducted. The antibacterial performance was tested by the Guang inspection testing and certification group, a nationally-accredited testing institution in China, and the results were listed in Table 2. The test strains were *Staphylococcus aureus, Colon bacilli*, and *Candida albicans*. It was tested by the Shaking flask method specified in FZ/T 73023-2006 ANNEX D, an industry standard for antibacterial knitwear in China, and the decrease rate was measured after the fabrics to which the fabric processing agent was applied were washed 50 times. The size of the fabric sample was 70 cm wide and 70 cm long, and the weight of the fabric sample was 98 g.

As a result of the test, *Staphylococcus aureus* showed a decrease rate of 97.09%, *Escherichia coli* showed a decrease rate of 97%, and *Candida albicans* showed a decrease rate of 91.52%.

TABLE 2

| Test item | Test method | Requirement | Test result | Con-clusion |
|---|---|---|---|---|
| ANTI-MICRO-BIAL ACTIVITY | FZ/T 73023-2006 ANNEX DSHAKE FLASK METHODAFTER 50 WASHING CYCLES | INHIBITION: *Staphylococcus aureus* ≥80% *Colon bacillus* ≥70% *Candida albicans* ≥60% | INHIBITION: *Staphylococcus aureus* 97.07% *Colon bacillus* 97.00% *Candida albicans* 91.52% | PASS |

Antibacterial Performance Test of Comparative Example 1

The antibacterial performance test was performed on the fabric of Comparative Example 1. The antibacterial performance was tested by the FITI test lab, and the results were listed in Table 3. The test strain was *Staphylococcus aureus* ATCC 6538, and the test was conducted according to an antimicrobial finishing method for fabric materials (AATCC 100-2012). As a result of recovering live cells from the fabric sample after 18 hours, it was found that the number of bacteria hardly decreased.

TABLE 3

| Control |
|---|
| $1.7 \times 10^5$ |
| $2.0 \times 10^8$ |
| — |

Experimental Example 2: Deodorization Performance Test

Deodorization Performance Test of Examples 1 and 2

The deodorization performance test of ammonia was performed with the fabric treated with the fabric processing agent prepared in Example 1. The ammonia deodorization performance was tested by the Swiss Universal Standard Technical Service Co., Ltd. (abbreviated as SGS). Ammonia deodorization evaluation was measured according to ISO 17299-2 by a detector tube method.

1 g of the fabric sample treated with the fabric processing agent prepared in Example 1 was put into a 3 L tedlar bag, ammonia with an initial concentration of 100 ppm was injected, and the residual ammonia concentration was measured with a detector tube after 2 hours to calculate the deodorization rate (%) by the following method. When the fabric containing the ammonia with an initial concentration of 100 ppm was washed according to the JIS L-0217 103 method, the acceptability criterion for the deodorization test of the Japan Textile Evaluation Technology Council was 70% of the deodorization rate. When it was determined that this acceptability criterion was a sufficient deodorization rate in general, the deodorization rate of the fabric sample treated with the fabric processing agent was 87.0%, which had a significant deodorization efficacy.

$$\text{Deodorization rate (\%)}=(B-A)/B*100\%$$

B: Control, residual ammonia concentration in the tedlar bag after 2 hours

A: Fabric sample, residual ammonia concentration in tedlar bag after 2 hours

The fabric treated with the fabric processing agent prepared in Example 2 was also subjected to a deodorization performance test in the same manner as in Example 1.

1 g of the fabric sample treated with the fabric processing agent prepared in the above example was put in a 3 L tedlar bag, ammonia with an initial concentration of 100 ppm was injected, and the residual ammonia concentration was measured with a detector tube after 2 hours to calculate the deodorization rate (%) by the following method. When the fabric containing the ammonia with an initial concentration of 100 ppm was washed according to the JIS L-0217 103 method, the acceptability criterion for the deodorization test of the Japan Textile Evaluation Technology Council was 70% of the deodorization rate. When it was determined that this acceptability criterion was a sufficient deodorization rate in general, the deodorization rate of the fabric sample treated with the fabric processing agent was 79.8%, which had a satisfactory deodorization efficacy.

$$\text{Deodorization rate (\%)}=(B-A)/B*100\%$$

B: Control, residual ammonia concentration in the tedlar bag after 2 hours

A: Fabric sample, residual ammonia concentration in tedlar bag after 2 hours

Table 4 below shows the deodorization performance test results of Examples 1 and 2.

TABLE 4

| Deodorization rate of sample |
|---|
| 87.0% |
| 79.8% |

Deodorization Performance Test of Comparative Example 1

The deodorization performance test of ammonia was performed with the fabric prepared in Comparative Example 1. The ammonia deodorization performance was tested by the Swiss Universal Standard Technical Service Co., Ltd. (abbreviated as SGS). Ammonia deodorization evaluation was measured according to ISO 17299-2 by a detector tube method.

1 g of the fabric sample prepared in the above Comparative Example 1 was put in a 3 L tedlar bag, ammonia with an initial concentration of 100 ppm was injected, and the residual ammonia concentration was measured with a detector tube after 2 hours to calculate the deodorization rate (%) by the following method. When the fabric containing the ammonia with an initial concentration of 100 ppm was washed according to the JIS L-0217 103 method, the acceptability criterion for the deodorization test of the Japan Textile Evaluation Technology Council was 70% of the deodorization rate. When it was determined that this acceptability criterion was a sufficient deodorization rate in general, the deodorization rate of the fabric sample not treated with the fabric processing agent was 10.1%, which did not satisfy the acceptability criterion.

$$\text{Deodorization rate (\%)}=(B-A)/B*100\%$$

B: Control, residual ammonia concentration in the tedlar bag after 2 hours

A: Fabric sample, residual ammonia concentration in tedlar bag after 2 hours

Table 5 below shows the deodorization performance test result of Comparative Example 1.

TABLE 5

| | Deodorization rate of sample | Acceptability criterion for deodorization test (Washing according to JIS L-0217103 method) |
|---|---|---|
| Comparative Example 1 | 10.1% | 70% |

Experimental Example 3: Far-Infrared Emissivity Performance Test

Far-Infrared Emissivity Performance Test of Examples 1 and 2

The far-infrared emissivity performance test was performed with the fabric treated with the fabric processing agent prepared in Example 1. The far-infrared emissivity performance was tested by the Korea Far Infrared Application Evaluation Institute (KIFA). The emissivity and radiant energy measurement tests were performed using the textile of the fabric product treated with the fabric processing agent prepared in Example 1 as a specimen by the KFIA-FI-1005 method of the Korea Far Infrared Application Evaluation Institute.

This test was carried out at 37° C. and was measured against a black body using a Fourier transform infrared spectroscopy (FT-IR) spectrometer.

It was confirmed that the fabric treated with the fabric processing agent prepared in Example 1 had an emissivity of 0.888 in a wavelength range of 5 to 20 μm, and a radiation energy of $3.42\times10^2$ W/m$^2$·μm.

The fabric treated with the fabric processing agent prepared in Example 2 was also subjected to the far-infrared emissivity performance test in the same manner as in Example 1.

It was confirmed that the fabric treated with the fabric processing agent prepared in Example 2 had an emissivity of 0.886 in a wavelength range of 5 to 20 μm, and a radiation energy of $3.42\times10^2$ W/m$^2$·μm.

Considering the fact that the far-infrared emissivity is recognized as excellent worldwide when the far-infrared emissivity is 0.850 or more, it was confirmed that the fabrics treated with the fabric processing agent prepared in Examples 1 and 2 according to the present invention had very excellent far-infrared emissivity.

Table 6 below shows the far-infrared emissivity performance tests of Examples 1 and 2

TABLE 6

| | Emissivity (5 to 20 μm) | Radiation energy (W/m$^2$ · μm, 37° C.) |
|---|---|---|
| Example 1 | 0.888 | $3.42 \times 10^2$ |
| Example 2 | 0.886 | $3.42 \times 10^2$ |

* Note
1) Test method: KFIA-FI-1005,
2) Test temperature: 37° C.,
3) Measurement method: Blackbody contrast measurement using FT-IR spectrometer

Far-Infrared Emissivity Performance Test of Comparative Example 2

The far-infrared emissivity performance test was performed with the fabric prepared in Comparative Example 2. The far-infrared emissivity performance was tested by the Korea Far Infrared Application Evaluation Institute (KIFA). The emissivity and radiant energy measurement tests were performed using the textile of the fabric product treated with the fabric processing agent prepared in the Example as a specimen by the KFIA-FI-1005 method of the Korea Far Infrared Application Evaluation Institute.

It was confirmed that the fabric treated with the fabric processing agent prepared in Comparative Example 2 had an emissivity of 0.844 in a wavelength range of 5 to 20 μm, and a radiation energy of $3.25\times10^2$ W/m$^2$·μm. The results were less than the far-infrared emissivity of Examples 1 and 2.

Table 7 below shows the far-infrared emissivity performance test of Comparative Example 2.

TABLE 7

| | Emissivity (5 to 20 μm) | Radiation energy (W/m$^2$ · μm, 37° C.) |
|---|---|---|
| Comparative Example 1 | 0.844 | $3.25 \times 10^2$ |

* Note
1) Test method: KFIA-FI-1005,
2) Test temperature: 37° C.,
3) Measurement method: Blackbody contrast measurement using FT-IR spectrometer

The invention claimed is:

1. A method for manufacturing a fabric processing agent, comprising the steps of:

preparing a first aqueous solution containing an organic acid and chitosan and a second aqueous solution containing a metal salt or an acidic solution; preparing a third aqueous solution in which a mixing ratio of the first aqueous solution to the second aqueous solution is a ratio of 2:1 to 10:1 by weight;

preparing a fourth aqueous solution in which a mixing ratio of ceramic powder to the organic acid is a ratio of 1:20 to 1:1000 by weight; and preparing a fabric processing agent in which a mixing ratio of the third aqueous solution to the fourth aqueous solution is a ratio of 1:5 to 5:1 by weight.

2. The method according to claim 1, wherein the organic acid is at least one selected from the group consisting of lactic acid, citric acid, mandelic acid, and acetic acid.

3. The method according to claim 1, wherein in the first aqueous solution, a mixing ratio of the organic acid to the chitosan is a ratio of 1:5 to 5:1 by weight.

4. The method according to claim 1, wherein a viscosity of the chitosan is 500 to 1200 cps.

5. The method according to claim 1, wherein a deacetylation degree of the chitosan is 80 to 99.99%.

6. The method according to claim 1, wherein a molecular weight of the chitosan is 10,000 to 1,000,000 g/mol.

7. The method according to claim 1, wherein the ceramic powder is at least one selected from the group consisting of zeolite powder, illite powder, montmorillonite powder, mica powder, diatomaceous earth powder, zirconia powder, and carbon powder.

8. The method according to claim 1, wherein in the step of preparing a first aqueous solution, an aqueous solution containing 0.01 to 5% by weight of the organic acid and an aqueous solution containing 0.01 to 5% by weight of the chitosan are stirred at room temperature at a speed of 100 to 1,000 rpm.

9. The method according to claim 1, wherein in the second aqueous solution, a mixing ratio of the metal salt or the acidic solution to distilled water is a ratio of 1:10 to 1:1000 by weight.

10. The method according to claim 1, wherein the metal salt is at least one selected from sodium chloride, calcium chloride, potassium chloride, sodium gluconate, and magnesium chloride.

11. The method according to claim 1, wherein the acidic solution is at least one selected from the group consisting of alginic acid, malic acid, acetic acid, citric acid, calcium acetate monohydrate, butyl lactate, ethyl lactate, and glycerin.

12. A method for manufacturing a fabric processing agent, comprising the steps of:

preparing a first aqueous solution containing an organic acid and chitosan;

preparing a fourth aqueous solution in which a mixing ratio of ceramic powder to the organic acid is a ratio of 1:20 to 1:1000 by weight; and preparing a fabric processing agent in which a mixing ratio of the first aqueous solution to the fourth aqueous solution is a ratio of 1:5 to 5:1 by weight.

13. The method according to claim 12, wherein the organic acid is at least one selected from the group consisting of lactic acid, citric acid, mandelic acid, and acetic acid.

14. The method according to claim 12, wherein in the first aqueous solution, a mixing ratio of the organic acid to the chitosan is a ratio of 1:5 to 5:1 by weight.

15. The method according to claim 12, wherein a viscosity of the chitosan is 500 to 1200 cps.

16. The method according to claim 12, wherein a deacetylation degree of the chitosan is 80 to 99.99%.

17. The method according to claim 12, wherein a molecular weight of the chitosan is 10,000 to 1,000,000 g/mol.

18. The method according to claim 12, wherein the ceramic powder is at least one selected from the group consisting of zeolite powder, illite powder, montmorillonite powder, mica powder, diatomaceous earth powder, zirconia powder, and carbon powder.

19. The method according to claim 12, wherein in the step of preparing a first aqueous solution, an aqueous solution containing 0.01 to 5% by weight of the organic acid and an aqueous solution containing 0.01 to 5% by weight of the chitosan are stirred at room temperature at a speed of 100 to 1,000 rpm.

* * * * *